US008357284B2

(12) United States Patent
Susaki et al.

(10) Patent No.: US 8,357,284 B2
(45) Date of Patent: Jan. 22, 2013

(54) METHOD FOR FORMING METAL FILM

(75) Inventors: Akira Susaki, Tokyo (JP); Tsutomu Nakada, Tokyo (JP); Hideki Tateishi, Kanagawa (JP)

(73) Assignee: Ebara Corporation, Tokyo (JP)

( * ) Notice: Subject to any disclaimer, the term of this patent is extended or adjusted under 35 U.S.C. 154(b) by 146 days.

(21) Appl. No.: 12/977,592

(22) Filed: Dec. 23, 2010

(65) Prior Publication Data

US 2011/0155581 A1 Jun. 30, 2011

(30) Foreign Application Priority Data

Dec. 25, 2009 (JP) ..... 2009-294616

(51) Int. Cl.

| | |
|---|---|
| ***C25D 5/12*** | (2006.01) |
| ***C25D 5/10*** | (2006.01) |
| ***C25D 5/34*** | (2006.01) |
| ***C25D 5/38*** | (2006.01) |
| ***C25D 5/44*** | (2006.01) |

(52) U.S. Cl. ..... 205/182; 202/181; 202/210; 202/212; 202/213; 202/219

(58) Field of Classification Search ..... 205/170, 205/181, 182, 210, 212, 213, 219, 261, 269, 205/271, 291

See application file for complete search history.

(56) References Cited

U.S. PATENT DOCUMENTS

| | | | | |
|---|---|---|---|---|
| 2,383,895 | A * | 8/1945 | Stareck et al. | 205/296 |
| 6,676,823 | B1 * | 1/2004 | Bokisa | 205/296 |
| 7,964,506 | B1 * | 6/2011 | Ponnuswamy et al. | 438/687 |
| 2003/0203617 | A1 * | 10/2003 | Lane et al. | 438/627 |
| 2006/0189129 | A1 * | 8/2006 | Baskaran et al. | 438/652 |
| 2007/0141818 | A1 * | 6/2007 | Basol | 438/584 |
| 2009/0250352 | A1 * | 10/2009 | Dubin et al. | 205/143 |

FOREIGN PATENT DOCUMENTS

| | | |
|---|---|---|
| JP | 2008-111093 | 5/2008 |

* cited by examiner

*Primary Examiner* — Edna Wong
(74) *Attorney, Agent, or Firm* — Wenderoth, Lind & Ponack, L.L.P.

(57) ABSTRACT

A metal film-forming method is capable of forming a metal film on a surface of a base metal film, formed on a surface of a substrate, with sufficient adhesion to the base metal film even when a natural oxide film is formed on the surface of the base metal film. The metal film-forming method includes: preparing a substrate having a base metal film formed on a surface; and carrying out electroplating of the substrate using the base metal film as a cathode and another metal as an anode while immersing the substrate in a solution containing a metal complex and a reducing material, both dissolved in a solvent, to form a metal film, deriving from a metal contained in the metal complex, on the surface of the base metal film.

7 Claims, 5 Drawing Sheets

W
W
W
50
50
50
52
52
52
54
54
54
56
58
58
60

METHOD FOR FORMING METAL FILM

BACKGROUND OF THE INVENTION

1. Field of the Invention

The present invention relates to a metal film-forming method which is useful for forming a metal film, such as a copper interconnect film for circuit interconnects, on a surface of a substrate such as an electronic circuit substrate.

2. Description of the Related Art

Because of advantageous such as low interconnection resistance, copper is frequently used these days as an interconnect material for an electronic circuit substrate. A copper interconnect film is generally formed by plating. In the formation of a copper interconnect film on a surface of a substrate by plating, it is common practice to form a base metal film, such as tungsten, titanium, tantalum or ruthenium, on the surface of the substrate prior to plating in order to feed electricity to the entire substrate and prevent a reaction of copper with a base material upon plating.

When a base metal film, after its formation, is allowed to stand in the air, a natural oxide film will be formed on a surface of the base metal film. When copper plating is carried out on a surface of such a base metal film with a natural oxide film formed thereon, a copper plated film may not be formed or, if formed, the adhesion strength of the copper plated film to the base metal film will be low. In particular, nowadays when the width of interconnects is becoming smaller, and thus the contact area between interconnects and a base metal film is becoming increasingly smaller, a low adhesion strength between a copper plated film, constituting interconnects, and a base metal film may lead to high resistance of the interconnects and even to no passage of electric current. To secure a sufficient adhesion strength between a copper plated film and a base metal film is therefore becoming an increasingly important problem.

Studies are therefore being conducted to remove a natural oxide film, which has been formed on a surface of a base metal film such as tungsten, titanium, tantalum or ruthenium, e.g., by a method which involves electrolytic treatment of the base metal film in an electrolytic solution or a method which involves reduction treatment of the base metal film with hydrogen gas. However, there is time restriction from the removal of a natural oxide film by such a method until the start of copper plating; and a complicated process or apparatus is necessary to carry out the removal of a natural oxide film and copper plating successively. It is desirable in terms of process control and apparatus construction if the formation of a metal film having strong adhesion to the surface of the base metal film can be carried out with ease.

A method which involves heat decomposition of copper formate has been proposed as a method to deposit copper on a surface of a resin substrate, e.g., made of an epoxy resin, thereby forming a copper film (see Japanese Patent Laid-Open Publication No. 2008-111093). In this method, the formation of the copper film on the surface of the substrate is carried out in an inert gas atmosphere into which ammonia gas is mixed. Because of the reducing power of ammonia gas, this method is considered to be capable of depositing copper through heat decomposition of copper formate while removing a natural oxide from a surface of a base metal film. Ammonia gas, however, is a deleterious substance, and therefore measures need to be taken for supply and disposal of ammonia gas, which necessitates a complicated treatment facility.

SUMMARY OF THE INVENTION

The present invention has been made in view of the above situation in the background art. It is therefore an object of the present invention to provide a metal film-forming method which does not necessitate any complicated apparatus to treat a deleterious substance, such as ammonia gas, and which is capable of forming a metal film, deriving from a metal contained in a metal complex dissolved in a solution, on a surface of a base metal film, formed on a surface of a substrate, with sufficient adhesion to the base metal film even when a natural oxide film is formed on the surface of the base metal film.

A method for forming a metal film developed by the applicant, comprising: preparing a substrate having a base metal film formed on a surface; immersing the substrate in a solution containing a metal complex and a reducing material, both dissolved in a solvent; and electrolyzing the solution using the substrate as a cathode and another metal plate, e.g., made of stainless steel, to form a metal film, deriving from a metal contained in the metal complex, on the surface of the base metal film.

According to this method, the metal complex in the solution decomposes to deposit the metal, contained in the metal complex, on the surface of the base metal film, without using a deleterious substance such as ammonia gas. In this manner, a metal film, having a sufficient adhesion strength to the base metal film, can be formed on the surface of the base metal film.

The present invention provides a method for forming a metal film, comprising: preparing a substrate having a base metal film formed on a surface; and carrying out electroplating of the substrate using the base metal film as a cathode and another metal as an anode while immersing the substrate in a solution containing a metal complex and a reducing material, both dissolved in a solvent, to form a metal film, deriving from a metal contained in the metal complex, on the surface of the base metal film.

By thus carrying out electroplating of the substrate using, as a plating solution, a solution containing a metal complex and a reducing material, both dissolved in a solvent, it becomes possible to form a metal film, having a sufficient adhesion strength to the base metal film, on the surface of the base metal film.

In a preferred aspect of the present invention, the base metal film is composed of tungsten, aluminum, tantalum, titanium, silicon or ruthenium; the metal complex is copper formate, nickel formate or cobalt formate; the reducing material is ammonium formate; and the solvent is pure water or a mixture of pure water and an organic material.

In a preferred aspect of the present invention, a concentration of copper formate, nickel formate or cobalt formate as a metal concentration is in a range from 1 to 50 g/L, and a concentration of ammonium formate is in a range from 50 to 100 g/L.

For example, a plating solution having a concentration of copper formate as a copper concentration of 10 g/L, and a concentration of ammonium formate of 80 g/L is preferably used.

In a preferred aspect of the present invention, pretreatment of the substrate is carried out by immersing the substrate in an alkaline treatment solution or an acidic treatment solution, or by subjecting the surface of the base metal film to electrolytic treatment or to reduction treatment with hydrogen gas.

By carrying out such pretreatment to perform surface modification of the base metal film, the adhesion between the base metal film and the metal film formed thereon can be enhanced.

In a preferred aspect of the present invention, after forming the metal film, deriving from a metal contained in the metal complex, on the surface of the base metal film, a second metal film is formed by electroplating on the metal film.

For example, when trenches provided in the substrate are not fully filled with the metal film formed on the surface of the base metal film, the trenches can be fully filled with the second metal film formed on the metal film.

According to the present invention, it becomes possible to deposit a metal, contained in a metal complex dissolved in a solution, on a surface of a base metal film and to thereby form a metal film on the surface of the base metal film with sufficient adhesion to the base metal film without using a deleterious substance, such as ammonia gas, and thus without using a complicated apparatus to treat a deleterious substance even when a natural oxide film is formed on the surface of the base metal film.

DETAILED DESCRIPTION OF THE PREFERRED EMBODIMENTS

Preferred embodiments of the present invention will now be described with reference to the drawings. The following description illustrates an exemplary case in which a copper film as a metal film, which is to be used as copper interconnects, is formed on a surface of a base metal film of titanium, formed on a surface of a substrate. Besides titanium, other metals such as aluminum, tantalum, tungsten, silicon and ruthenium, may also be used as a material for a base metal film. Instead of a copper film, it is possible to form, for example, a nickel film or a cobalt film as a metal film.

Figure 1:
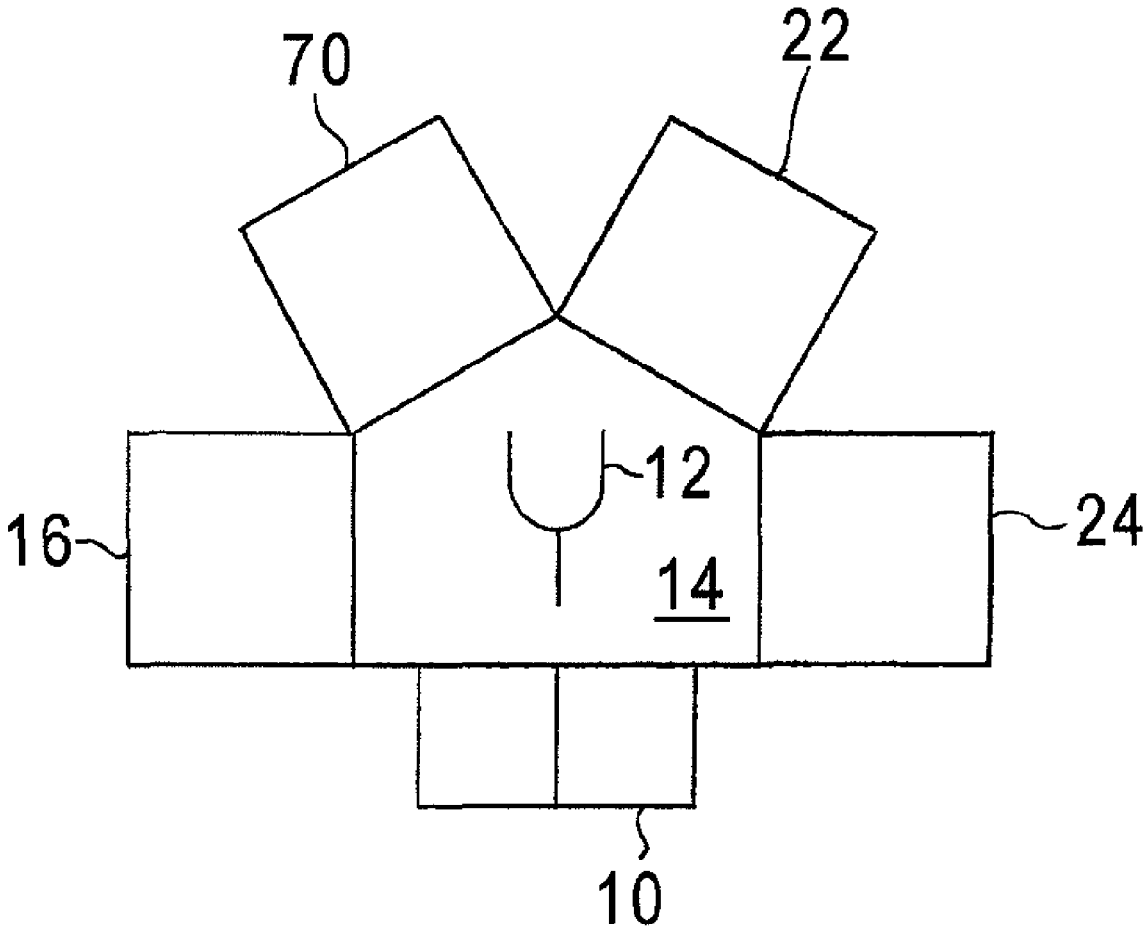
FIG. 1 is an overall plan view of a metal film-forming apparatus.

FIG. 1 shows an overall plan view of a metal film-forming apparatus. As shown in FIG. 1, the metal film-forming apparatus includes a loading/unloading section 10 for carrying a substrate into and out of the apparatus, and a substrate transport chamber 14 in which a transport robot 12, as a transport mechanism, is disposed. To the substrate transport chamber 14 are radially coupled a pretreatment unit 16, an electroplating unit (copper electroplating unit in this embodiment) 70, a trench-filling copper plating unit 22 for carrying out trench-filling copper plating, and a cleaning/drying unit 24. The transport robot 12 disposed in the substrate transport chamber 14 thus is configured to transfer a substrate between the loading/unloading section 10, the pretreatment unit 16, the electroplating unit 70, the trench-filling copper plating unit 22 and the cleaning/drying unit 24. It is desirable that an exhaust mechanism be provided for each unit or for the entire apparatus.

The pretreatment unit 16 is to carry out pretreatment (surface modification) of a base metal film formed on a surface of a substrate, and in this embodiment is designed to immerse a substrate in pure water, e.g., at room temperature to improve the wettability of the surface of the substrate. Instead of pure water, it is possible to use an acidic treatment solution, such as an aqueous 2% sulfuric acid solution as a pretreatment liquid. The pretreatment unit 16 may also be designed to carry out electrolytic treatment of a base metal film, e.g., in a 2-10% potassium hydroxide solution, or to carry out reduction treatment with hydrogen gas of a base metal film, e.g., in a 4% hydrogen gas (the remainder is nitrogen gas).

Figure 2:
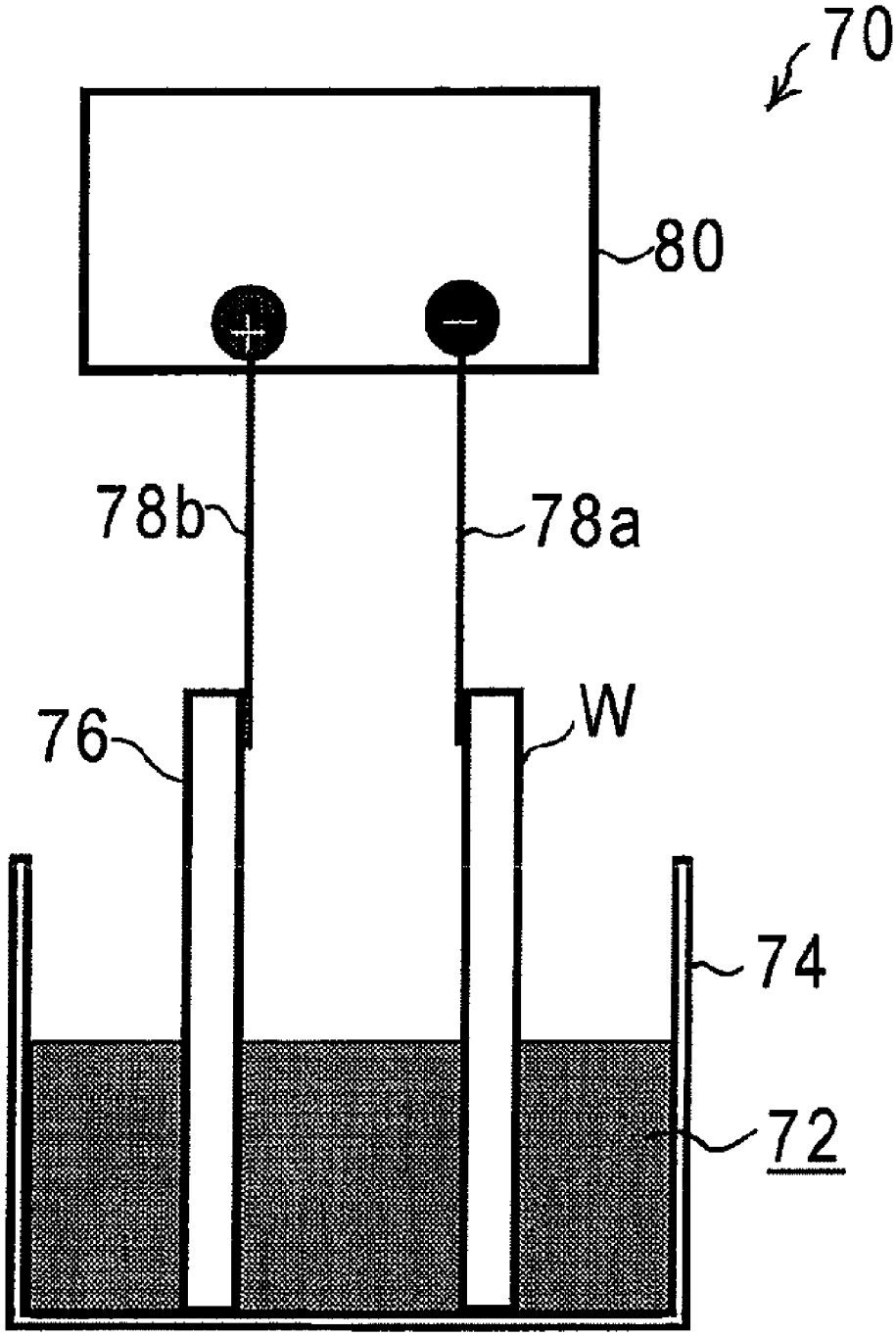
FIG. 2 is a schematic view of an electroplating unit provided in the metal film-forming apparatus shown in FIG. 1.

FIG. 2 schematically shows the electroplating unit 70. The electroplating unit 70 includes a plating tank 74 for holding therein a plating solution 72, and an anode 76, e.g., made of stainless steel. In this embodiment, a solution containing copper formate as a metal complex, and ammonium formate as a reducing material, both dissolved in pure water as a solvent, is used as the plating solution 72. The plating solution 72 has a concentration of copper formate as a copper concentration of, for example, 1-50 g/L. This holds true for a concentration of nickel formate or cobalt formate as a metal concentration of a plating solution containing nickel formate or cobalt formate. The plating solution 72 has a concentration of ammonium formate, for example, 50-100 g/L. For example, a plating solution having a concentration of copper formate as a copper concentration of 10 g/L, and a concentration of ammonium formate of 80 g/L is preferably used as the plating solution 72.

A substrate W and the anode 76, disposed opposite each other, are then immersed in the plating solution 72 in the plating tank 74. The base metal film 54 (see FIG. 4A) of the substrate W is connected via a conducting wire 78*a* to the cathode of a plating power source 80, while the anode 76 is connected via a conducting wire 78*b* to the anode of the plating power source 80. A plating current is passed between the base metal film 54 and the anode 76, e.g., at a current density of 5 $mA/cm^2$ per unit area of the base metal film 54 to cause copper, contained in the copper formate as a metal complex contained in the plating solution 72, to deposit on the surface of the base metal film 54, thereby forming a copper film 58 (see FIG. 4B).

Figure 3:
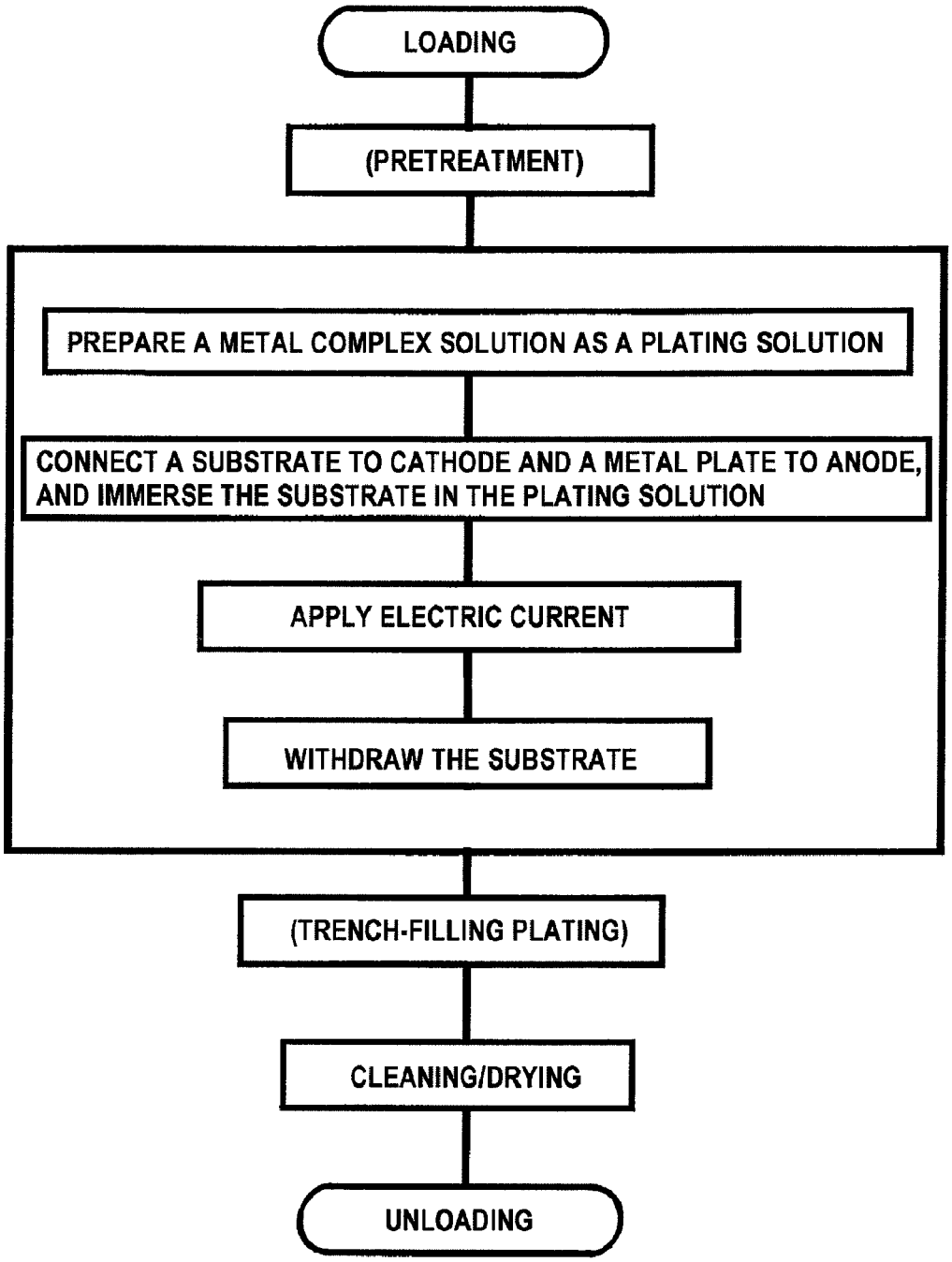
FIG. 3 is a flow chart of a metal film-forming process carried out in the metal film-forming apparatus shown in FIG. 1.
Figures 4A, 4B, 4C:
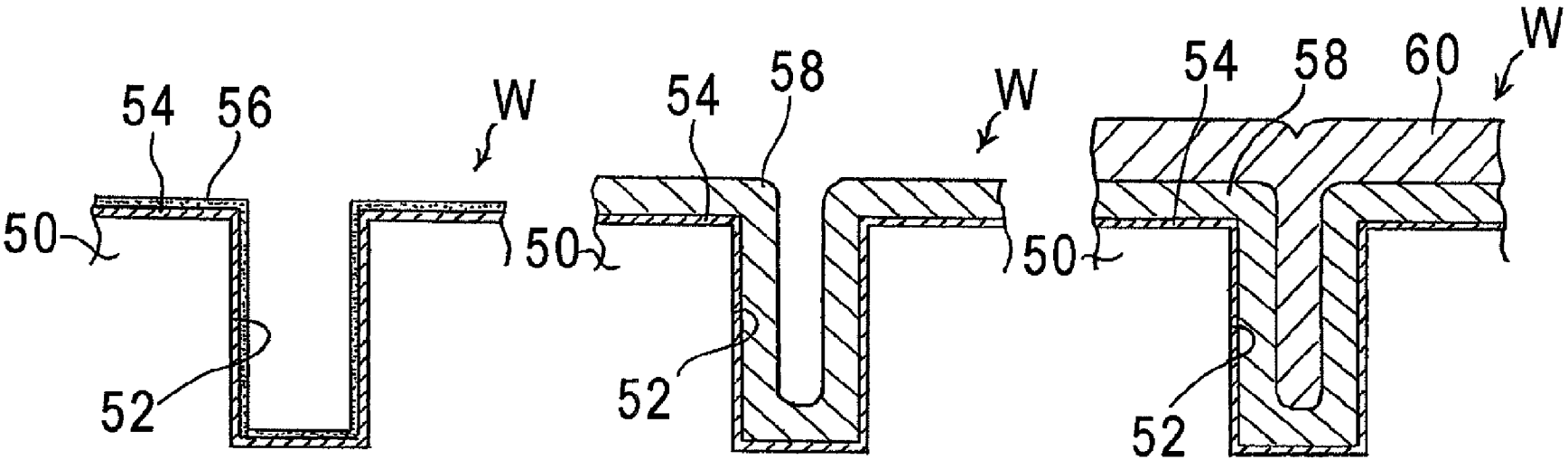
FIGS. 4A through 4C are diagrams illustrating, in a sequence of process steps, a metal film-forming process carried out in the metal film-forming apparatus shown in FIG. 1.

An exemplary metal film-forming process carried out in the metal film-forming apparatus shown in FIG. 1 will now be described with reference to FIGS. 3 and 4. First, a substrate W in which surfaces of trenches 52 formed in an insulating film 50 are covered with a base metal film 54 of titanium, as shown in FIG. 4A, is prepared. When the substrate W having the base metal film 54 formed on the surfaces of the trenches 52 is allowed to stand in the air, a natural oxide film 56 is formed on the surface of the base metal film 54. In FIGS. 4A through 4C, depiction of lower-level interconnects is omitted.

One substrate W is taken by the transport robot 12 out of a substrate cassette, having a number of substrates W housed therein, set in the loading/unloading section 10, and the substrate W is carried into the apparatus.

The substrate W is then carried into the pretreatment unit 16, where the substrate W is subjected to pretreatment (surface modification treatment) of the base metal film 54 formed on the surface of the substrate W. In this embodiment, the pretreatment of the substrate W is carried out, for example, by immersing the substrate W in pure water at room temperature for one minute.

The substrate W, to which pretreatment (surface modification treatment) of the surface of the base metal film 54 has been carried out in the pretreatment unit 16, is carried into the electroplating unit 70. In the electroplating unit 70, electroplating of the substrate W is carried out, e.g., for 9 minutes, e.g., at a current density of 5 $mA/cm^2$ per unit area of the base metal film 54, using as the plating solution 72 a solution containing copper formate as a metal complex and ammonium formate as a reducing material, both dissolved in pure water as a solvent. A copper film (metal film) 58 is formed on the surface of the base metal film 54 by the electroplating, as shown in FIG. 4B.

During the electroplating, the copper formate is decomposed and copper deposits firmly on the surface of the base metal film 54, whereby the copper film 58 is formed on the surface of the base metal film 54.

Next, the substrate W is carried into the trench-filling copper plating unit 22, where the substrate W is subjected to copper electroplating, e.g., using a copper sulfate plating solution as a plating solution to form a trench-filling copper film (second metal film) 60 on the surface of the copper film 58, as shown in FIG. 4C. Thereafter, the substrate W is carried into the cleaning/drying unit 24, where pure water is supplied to the surface of the substrate W to rinse the surface with pure water, and the substrate W is then rotated at a high speed for spin drying. The substrate W after drying is returned to the substrate cassette in the loading/unloading section 10.

A tape test for evaluation was conducted on a copper film (metal film) sample which had been formed on a surface of a base metal film of titanium having a natural oxide film by electroplating using as the plating solution 72 a solution containing copper formate as a metal complex, and ammonium formate as a reducing material, both dissolved in pure water as a solvent. The electroplating was carried out while varying the concentration of copper formate or ammonium formate of the plating solution at a current density of 5 $mA/cm^2$ per unit area of the base metal film (titanium).

As a result, the adhesion strength of the copper film to the base metal film was best when the copper film was formed by electroplating using a plating solution having a concentration of copper formate as a copper concentration of 10 g/L and a concentration of ammonium formate of 80 g/L, and the copper film was found not to be peeled from the base metal film. In contrast, it has been confirmed that a copper film, formed by electroplating using a plating solution having a concentration of ammonium formate of less than 50 g/L or of more than 100 g/L, had a poor adhesion strength to the base metal, and the copper film was found to be peeled from the base metal film with tape. The tape test is a method commonly used to evaluate the adhesion strength of a film, and is performed by attaching an adhesive tape to a film surface strongly, and quickly removing the tape by pulling one end at a certain angle (see e.g., "21st-Century Edition Handbook of Film Production and Application", p. 175, N.T.S Co., Ltd.).

For comparison, the tape test was conducted on two copper film (metal film) samples which each had been formed on a surface of a base metal film (titanium film) by copper electroplating carried out in the same manner but using as a plating solution an aqueous solution containing only copper formate or a copper sulfate plating solution. As a result, both of the two copper film samples were found to be peeled from the base metal film.

It has also been confirmed experimentally that the use of a suppressor (e.g., polyethylene glycol), an accelerator (e.g., bis(3-sulfopropyl) disulfide (SPS)), a leveler (e.g., Janus Green B (JGB)) and chlorine as additives in the above-described plating solution 72 can improve the gloss and the thickness uniformity of a copper plated film.

Thus, a copper film (metal film) having a high adhesion strength to a base metal film can be formed on a surface of the base metal film by performing general plating as in this embodiment.

Figure 5:
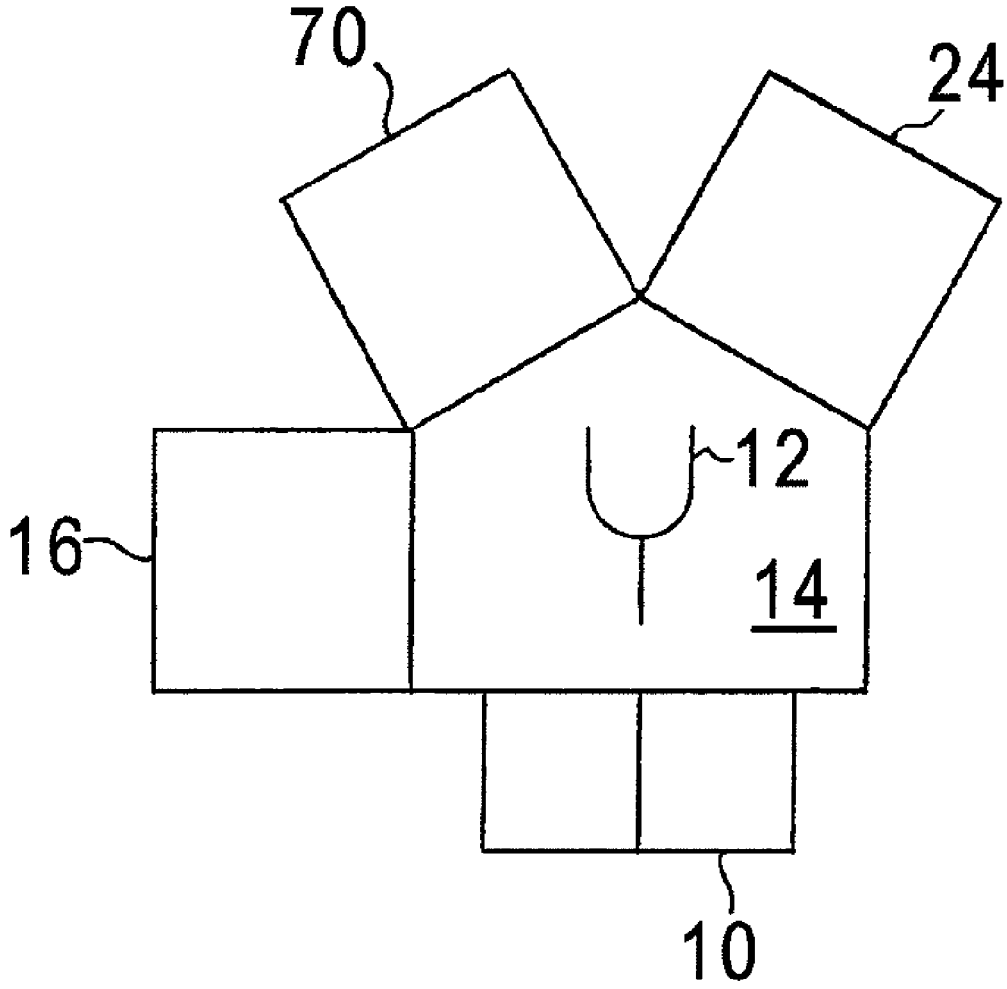
FIG. 5 is an overall plan view of another metal film-forming apparatus.

FIG. 5 shows an overall plan view of another metal film-forming apparatus. The metal film-forming apparatus shown in FIG. 5 differs from the metal film-forming apparatus shown in FIG. 1 in that the trench-filling copper plating unit 22, provided in the apparatus of FIG. 1, is omitted.

While the present invention has been described with reference to preferred embodiments, it is understood that the present invention is not limited to the embodiments, but is capable of various modifications within the general inventive concept described herein.

What is claimed is:

1. A method for forming a copper film on a surface of a substrate, comprising:

preparing a substrate having a base metal film formed on a surface;

carrying out a first electroplating process of the substrate using the base metal film as a cathode and another metal as an anode while immersing the substrate in a first plating solution containing copper formate and ammonium formate as a reducing material, both dissolved in a solvent, to form a first copper film on a surface of the base metal film; and then carrying out a second electroplating process of the substrate using a copper sulfate plating solution to form a second copper film on the first copper film.

2. The method according to claim 1, wherein the base metal film is composed of tungsten, aluminum, tantalum, titanium, silicon or ruthenium.

3. The method according to claim 1, wherein the first plating solution comprises the copper in the copper formate in a concentration range from 1 to 50 g/L, and the first plating solution comprises the ammonium formate in a concentration range from 50 to 100 g/L.

4. The method according to claim 1, wherein prior to carrying out the first electroplating process, of the substrate is pretreated by immersing the substrate in an alkaline treatment solution or an acidic treatment solution, or by subjecting the surface of the base metal film to electrolytic treatment or to reduction treatment with hydrogen gas.

5. The method according to claim 1, wherein the first plating solution further contains at least one additive selected from the group consisting of a suppressor, an accelerator, a leveler and chlorine.

6. The method according to claim 1, wherein the solvent of the first plating solution is pure water or a mixture of pure water and an organic material.

7. The method according to claim 1, wherein the anode is made of stainless steel.

* * * * *